US012600918B2

(12) United States Patent
Takekawa et al.

(10) Patent No.: US 12,600,918 B2
(45) Date of Patent: Apr. 14, 2026

(54) LUBRICATING OIL COMPOSITION

(71) Applicant: IDEMITSU KOSAN CO., LTD., Chiyoda-ku (JP)

(72) Inventors: Daisuke Takekawa, Sodegaura (JP); Kentaro Kojima, Chiba (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 18/245,606

(22) PCT Filed: Dec. 13, 2021

(86) PCT No.: PCT/JP2021/045873
§ 371 (c)(1),
(2) Date: Mar. 16, 2023

(87) PCT Pub. No.: WO2022/138292
PCT Pub. Date: Jun. 30, 2022

(65) Prior Publication Data

US 2023/0332067 A1 Oct. 19, 2023

(30) Foreign Application Priority Data

Dec. 21, 2020 (JP) ..... 2020-211542

(51) Int. Cl.

| | |
|---|---|
| ***C10M 141/10*** | (2006.01) |
| ***C10N 30/00*** | (2006.01) |
| ***C10N 30/02*** | (2006.01) |
| ***C10N 30/06*** | (2006.01) |
| ***C10N 40/04*** | (2006.01) |
| ***C10N 40/08*** | (2006.01) |

(52) U.S. Cl.
CPC .. *C10M 141/10* (2013.01); *C10M 2203/1025* (2013.01); *C10M 2209/084* (2013.01); *C10M 2215/04* (2013.01); *C10M 2215/042* (2013.01); *C10M 2223/043* (2013.01); *C10M 2223/045* (2013.01); *C10N 2030/02* (2013.01); *C10N 2030/06* (2013.01); *C10N 2030/52* (2020.05); *C10N 2040/04* (2013.01); *C10N 2040/08* (2013.01)

(58) Field of Classification Search
CPC ..... C10M 141/10; C10M 2203/1025; C10M 2209/084; C10M 2215/04; C10M 2215/042; C10M 2215/043; C10M 2215/045; C10N 2030/02; C10N 2030/06; C10N 2030/52; C10N 2040/04; C10N 2040/08
See application file for complete search history.

(56) References Cited

U.S. PATENT DOCUMENTS

| | | | | |
|---|---|---|---|---|
| 3,652,410 | A * | 3/1972 | Hollinghurst | F23N 5/02 508/438 |
| 2008/0058235 | A1 | 3/2008 | Takigawa et al. | |
| 2009/0082232 | A1 | 3/2009 | Ikeda et al. | |
| 2014/0179577 | A1* | 6/2014 | Loper | C10M 163/00 508/513 |
| 2015/0096463 | A1* | 4/2015 | Shibata | C10M 101/02 106/14.42 |
| 2015/0232780 | A1 | 8/2015 | Shrestha et al. | |
| 2016/0152920 | A1 | 6/2016 | Miyamoto et al. | |
| 2017/0022441 | A1* | 1/2017 | Onodera | C10M 141/12 |
| 2018/0023026 | A1 | 1/2018 | Kusuhara | |

FOREIGN PATENT DOCUMENTS

| | | | |
|---|---|---|---|
| CN | 1400295 | A | 3/2003 |
| CN | 101368128 | A | 2/2009 |
| CN | 102533404 | A | 7/2012 |
| CN | 103911202 | A | 7/2014 |
| CN | 105255545 | A | 1/2016 |
| CN | 105733747 | A | 7/2016 |
| CN | 106133124 | A | 11/2016 |
| CN | 108865346 | A | 11/2018 |
| JP | 2000-219888 | A1 | 8/2000 |
| JP | 2002-38180 | A1 | 2/2002 |
| JP | 2005-307202 | A | 11/2005 |

(Continued)

OTHER PUBLICATIONS

International Search Report and Written Opinion issued Feb. 15, 2022, in PCT/JP2021/045873 (with English Translation), 18 pages.
"Basic Knowledge of Lubrication Technology for Metallurgical Equipment", Lubrication Group of the Equipment Management and Maintenance Technology Exchange Center for Iron and Steel Enterprises under the Ministry of Metallurgical Industry, China Petrochemical Press. Nov. 30, 1991, 9 pages (with unedited computer-generated English translation).
Combined Chinese Office Action and Search Report issued Jun. 27, 2025 in Chinese Patent Application No. 202180064590.2 (with unedited computer-generated Enlglish translation), 23 pages.

(Continued)

*Primary Examiner* — James C Goloboy
(74) *Attorney, Agent, or Firm* — Oblon, McClelland, Maier & Neustadt, L.L.P.

(57) ABSTRACT

A lubricating oil composition contains a base oil (A), a zinc dithiophosphate (B), and a sarcosine compound (C), the composition having a content of the sarcosine compound (C) of more than 0.05% by mass and 0.40% by mass or less based on the entire amount of the lubricating oil composition, and satisfying requirement (α) or (β):
Requirement (α): when the content of the sarcosine compound (C) is more than 0.05% by mass and less than 0.20% by mass based on the lubricating oil composition, one or more phosphorus compounds (D) selected from an acidic phosphoric acid ester (D1) and an amine salt thereof (D2) are optionally contained;
Requirement (β): when the content of the sarcosine compound (C) is 0.20% to 0.40% by mass based on the lubricating oil composition, the phosphorus compound (D) is contained in an amount less than 0.50% by mass based on the lubricating oil composition.

20 Claims, No Drawings

(56) References Cited

FOREIGN PATENT DOCUMENTS

| | | | |
|---|---|---|---|
| JP | 2006-316147 | A | 11/2006 |
| JP | 2006-335963 | A | 12/2006 |
| JP | 2008-45111 | A | 2/2008 |
| JP | 2009-144045 | A | 7/2009 |
| JP | 2014-177605 | A | 9/2014 |
| JP | 2015-147859 | A | 8/2015 |
| JP | 2017-505852 | A | 2/2017 |
| JP | 2019-73628 | A | 5/2019 |
| WO | WO 2015/022976 | A1 | 2/2015 |
| WO | WO 2015/146666 | A1 | 10/2015 |
| WO | WO 2016/129465 | A1 | 8/2016 |

OTHER PUBLICATIONS

Japanese Office Action issued Sep. 9, 2025, in corresponding Japanese Patent Application No. 2022-572177 (with English Translation), 11 pages.

Office Action issued Feb. 17, 2026, in corresponding Japanese Patent Application No. 2022-572177 with English translation, 16 pages.

* cited by examiner

LUBRICATING OIL COMPOSITION

CROSS REFERENCE TO RELATED APPLICATIONS

This application is a National Stage entry under 35 U.S.C. § 371 of PCT/JP2021/045873, filed on Dec. 13, 2021, and claims priority to Japanese Patent Application No. 2020-211542, filed on Dec. 21, 2020, the entire contents of which are incorporated herein by reference.

TECHNICAL FIELD

The present invention relates to a lubricating oil composition.

BACKGROUND ART

Industrial machines, such as agricultural machines, construction machines, and transporting machines, are generally provided with a transmission (gear), a hydraulically actuated part, and the like. Among industrial machines, for example, agricultural machines, such as a tractor, a rice planting machine, a binder, and a combine; construction machines, such as a hydraulic power shovel, a truck-mounted crane, and a bulldozer; and transporting machines, such as a dump truck, a forklift, a shovel loader, and rough terrain hauler, are further provided with a wet brake. A transmission (gear), a hydraulically actuated part, and a wet brake provided in such a machine are generally lubricated by a common lubrication, that is, are lubricated with the same lubricating oil composition.

Various types of lubricating oil compositions have been proposed for use in such industrial machines. For example, PTL 1 proposes a tractor hydraulic fluid composition containing a major amount of an oil of lubricating viscosity, a specific detergent composition, a specific amount of at least one hydrocarbyl polyalcohol, and a specific amount of at least one zinc dialkyldithiophosphate having secondary alkyl groups.

CITATION LIST

Patent Literature

PTL 1; JP 2017-505852 T

SUMMARY OF INVENTION

Technical Problem

On the other hand, a problem peculiar to wet brake is brake squeal due to, for example, vibration caused by repetition of adhesion and slides of friction surfaces occurring between the friction surfaces, namely, stick-slip. Thus, a lubricating oil composition for use in an industrial machine provided with a wet brake is particularly required to have a performance to prevent the brake squeal (hereinafter also referred to as "brake squeal prevention performance").

In addition to that, when a transmission (gear), a hydraulically actuated part, and a wet brake provided in an industrial machine are lubricated by the same lubricating oil composition, namely, by a common lubrication, the lubricating oil composition used for the common lubrication is also required to have a performance to prevent seizure of the transmission (gear) (hereinafter also referred to as "anti-seizure performance".

However, PTL 1 does not study at all about achievement of both the brake squeal prevention performance and the anti-seizure performance. A friction modifier is sometimes added to a lubricating oil composition for the purpose of ensuring the brake squeal prevention performance, but when increasing the amount of the friction modifier added, the anti-seizure performance tends to decrease, whereas when reducing the amount of the friction modifier added, the brake squeal prevention performance may not be ensured. Thus, it has been difficult to achieve both the performances.

Thus, an object of the present invention is to provide a lubricating oil composition that is superior both in the brake squeal prevention performance and in the anti-seizure performance.

Solution to Problem

As a result of extensive and intensive studies, the present inventors have found that a lubricating oil composition that contains a base oil, a zinc dithiophosphate, and a sarcosine compound and satisfies a specific requirement can solve the above problem.

Specifically, the present invention relates to the following [1] to [2].

[1] A lubricating oil composition containing a base oil (A), a zinc dithiophosphate (B), and a sarcosine compound (C), the lubricating oil composition having a content of the sarcosine compound (C) of more than 0.05% by mass and 0.40% by mass or less based on the entire amount of the lubricating oil composition, and satisfying a requirement (α) or (β) described below:

requirement (α): when the content of the sarcosine compound (C) is more than 0.05% by mass and less than 0.20% by mass based on the entire amount of the lubricating oil composition, one or more phosphorus compounds (D) selected from the group consisting of an acidic phosphoric acid ester (D1) and an amine salt thereof (D2) are optionally contained;

requirement (β): when the content of the sarcosine compound (C) is 0.20% by mass or more and 0.40% by mass or less based on the entire amount of the lubricating oil composition, the phosphorus compound (D) is contained in an amount less than 0.50% by mass based on the entire amount of the lubricating oil composition.

[2] A method of lubricating an industrial machine, the method using the lubricating oil composition according to the above [1].

Advantageous Effects of Invention

According to the present invention, it is possible to provide a lubricating oil composition that is superior both in the brake squeal prevention performance and in the anti-seizure performance.

DESCRIPTION OF EMBODIMENTS

Upper limits and lower limits for a numerical range described herein can be arbitrarily combined. For example, when "A to B" and "C to D" are described as numerical ranges, the numerical ranges of "A to D" and "C to B" are also within the scope of the present invention.

Unless otherwise specified, a numerical range "a lower limit to an upper limit" described herein means the lower limit or more and the upper limit or less.

In this description, numerical values in Examples are numerical values that can be used as an upper limit or a lower limit.

[Aspect of Lubricating Oil Composition of the Present Invention]

The lubricating oil composition of the present invention contains a base oil (A), a zinc dithiophosp hate (B), and a sarcosine compound (C). The lubricating oil composition of the present invention has a content of the sarcosine compound (C) of more than 0.05% by mass and 0.40% by mass or less based on the entire amount of the lubricating oil composition, and satisfies a requirement (α) or (β) described below.

Requirement (α): when the content of the sarcosine compound (C) is more than 0.05% by mass and less than 0.20% by mass based on the entire amount of the lubricating oil composition, one or more phosphorus compounds (D) selected from the group consisting of an acidic phosphoric acid ester (D1) and an amine salt thereof (D2) are optionally contained.

Requirement (β): when the content of the sarcosine compound (C) is 0.20% by mass or more and 0.40% by mass or less based on the entire amount of the lubricating oil composition, the phosphorus compound (D) is contained in an amount less than 0.50% by mass based on the entire amount of the lubricating oil composition.

The present inventors have made extensive and intensive studies for solving the above problem. As a result, the present inventors have found that a lubricating oil composition containing a base oil (A), a zinc dithiophosphate (B), and a sarcosine compound (C), the content of the sarcosine compound (C) being adjusted within a specific range, is superior both in the brake squeal prevention performance and in the anti-seizure performance. The present inventors have also found that by further blending one or more phosphorus compounds (D) selected from the group consisting of an acidic phosphoric acid ester (D1) and an amine salt thereof (D2) into the lubricating oil composition, the range of the content of the sarcosine compound (C) that provides both a good brake squeal prevention performance and a good anti-seizure performance can be expanded. Based on the above findings, the present inventors have made further various studies, thus completing the present invention.

The mechanism of exhibiting the effect of the present invention is inferred as follows, for example. That is, in a lubricating oil composition in which only the zinc dithiophosphate (B) is blended or in a lubricating oil composition in which only the zinc dithiophosphate (B) and the phosphorus compound (D) are blended, although the anti-seizure performance is exhibited, the brake squeal prevention performance is not exhibited. Thus, it is inferred that blending of a specific amount of the sarcosine compound (C) into a lubricating oil composition greatly contributes to the exhibition of the brake squeal prevention performance. However, when the amount of the sarcosine compound (C) blended exceeds a specific amount, the brake squeal prevention performance is not exhibited. Thus, it has been found that, when the sarcosine compound (C) is contained alone for the brake squeal prevention performance, an appropriate amount is present for the sarcosine compound (C) blended. On the other hand, when the sarcosine compound is to be blended in an amount larger than the above appropriate amount for various reasons, some countermeasure is required because the brake squeal prevention performance is not exhibited as described above. Based on various studies, the present inventor has elucidated that in such a case, by blending the phosphorus compound (D), the brake squeal prevention performance is exhibited even in an amount of the sarcosine compound (C) blended in which the brake squeal prevention performance is not exhibited with the sarcosine compound (C) used alone. The reason why, by blending the phosphorus compound (D), the brake squeal prevention performance is exhibited even in an amount of the sarcosine compound (C) blended in which the brake squeal prevention performance is not exhibited with the sarcosine compound (C) used alone as described above, is inferred to be some interaction occurring between the sarcosine compound (C) and the phosphorus compound (D).

A lubricating oil composition of an aspect of the present invention may be constituted only of the base oil (A) (hereinafter also referred to as "component (A)", the zinc dithiophosphate (B) (hereinafter also referred to as "component (B)"), and the sarcosine compound (C) (hereinafter also referred to as "component (C)"), but may further contain the phosphorus compound (D) (hereinafter also referred to as "component (D)") under certain conditions.

In other words, a lubricating oil composition of an aspect of the present invention may be constituted only of the component (A), the component (B), and the component (C), or may be constituted only of the component (A), the component (B), the component (C), and the component (D).

In addition, a lubricating oil composition of an aspect of the present invention may further contain a component other than the component (A), the component (B), the component (C), and the component (D).

In a lubricating oil composition of an aspect of the present invention, the total content of the component (A), the component (B), and the component (C) is preferably 70% by mass or more, more preferably 75% by mass or more, further preferably 80% by mass or more based on the entire amount of the lubricating oil composition. The total content is also preferably 100% by mass or less, more preferably 97% by mass or less, further preferably 95% by mass or less.

The upper limits and the lower limits of the numerical ranges can be arbitrarily combined. Specifically, the total content is preferably 70% by mass to 100% by mass, more preferably 75% by mass to 97% by mass, further preferably 80% by mass to 95% by mass.

Alternatively, in a lubricating oil composition of an aspect of the present invention, the total content of the component (A), the component (B), the component (C), and the component (D) is preferably 70% by mass or more, more preferably 75% by mass or more, further preferably 80% by mass or more based on the entire amount of the lubricating oil composition. The total content is also preferably 100% by mass or less, more preferably 97% by mass or less, further preferably 95% by mass or less.

The upper limits and the lower limits of the numerical ranges can be arbitrarily combined. Specifically, the total content is preferably 70% by mass to 100% by mass, more preferably 75% by mass to 97% by mass, further preferably 80% by mass to 95% by mass.

Hereinunder, the requirement (α) and the requirement (β) defined in the lubricating oil composition of the present invention will be described in detail, and then, the components that constitute the lubricating oil composition of the present invention will be described in detail.

<Requirement (α) and Requirement (β)>

The lubricating oil composition of the present invention satisfies the requirement (α) or the requirement (β).

When a lubricating oil composition satisfies neither the requirement (α) nor the requirement (β), the effect of the present invention is not exhibited.

The requirement (α) and the requirement (β) will be described in detail below.

(Requirement (α))

In the lubricating oil composition of the present invention, the requirement (α) is defined as follows.

Requirement (α): when the content of the sarcosine compound (C) is more than 0.05% by mass and less than 0.20% by mass based on the entire amount of the lubricating oil composition, one or more phosphorus compounds (D) selected from the group consisting of an acidic phosphoric acid ester (D1) and an amine salt thereof (D2) are optionally contained.

In the lubricating oil composition of the present invention, the content of the sarcosine compound (C) is limited to more than 0.05% by mass and 0.40% by mass or less based on the entire amount of the lubricating oil composition. In the requirement (α), within the limited range, an aspect in the case of more than 0.05% by mass and less than 0.20% by mass is defined.

In other words, when the content of the sarcosine compound (C) is more than 0.05% by mass and less than 0.20% by mass, the phosphorus compound (D) may be contained or may not be contained. In either case, the effect of the present invention is exhibited. In addition, in the requirement (α), when the lubricating oil composition contains the phosphorus compound (D), the content is not limited.

In the requirement (α), when the phosphorus compound (D) is not contained, the content of the sarcosine compound (C) in the requirement (α) is, from the viewpoint of more easily exhibiting the effect of the present invention, preferably 0.07% by mass or more, more preferably 0.08% by mass or more, further preferably 0.09% by mass or more based on the entire amount of the lubricating oil composition. The content is also preferably 0.16% by mass or less, more preferably 0.13% by mass or less, further preferably 0.11% by mass or less.

The upper limits and the lower limits of the numerical ranges can be arbitrarily combined. Specifically, the content is preferably 0.07% by mass to 0.16% by mass, more preferably 0.08% by mass to 0.13% by mass, further preferably 0.09% by mass to 0.11% by mass.

In the requirement (α), when the phosphorus compound (D) is contained, the content of the sarcosine compound (C) in the requirement (α) is, from the viewpoint of more easily exhibiting the effect of the present invention, preferably 0.07% by mass or more, more preferably 0.08% by mass or more, further preferably 0.09% by mass or more based on the entire amount of the lubricating oil composition. The content is also preferably 0.19% by mass or less.

The upper limits and the lower limits of the numerical ranges can be arbitrarily combined. Specifically, the content is preferably 0.07% by mass to 0.19% by mass, more preferably 0.08% by mass to 0.19% by mass, further preferably 0.09% by mass to 0.19% by mass.

Here, when a lubricating oil composition of an aspect of the present invention satisfies the requirement (α), from the viewpoint of more easily exhibiting the effect of the present invention, the lubricating oil composition more preferably satisfies any one of a requirement (α1) and a requirement (α2) explained below, and further preferably satisfies both of the requirement (α1) and requirement (α2) explained below.

—Requirement (α1)—

In a lubricating oil composition of an aspect of the present invention, the requirement (α1) is defined as follows.

Requirement (α1): the sarcosine compound (C) and the zinc dithiophosphate (B) are contained at a ratio [(C)/(B)] of more than 0.04 and less than 0.17 by mass.

With a [(C)/(B)] in the above range, the effect of the present invention can be more easily exhibited.

Here, in the requirement (α1), when the phosphorus compound (D) is not contained, the [(C)/(B)] is, from the viewpoint of further easily exhibiting the effect of the present invention, preferably 0.05 or more, more preferably 0.06 or more, further preferably 0.07 or more by mass. The [(C)/(B)] is also preferably 0.14 or less, more preferably 0.11 or less, further preferably 0.10 or less by mass.

The upper limits and the lower limits of the numerical ranges can be arbitrarily combined. Specifically, the [(C)/(B)] is preferably 0.05 to 0.14, more preferably 0.06 to 0.11, further preferably 0.07 to 0.10.

In the requirement (α1), when the phosphorus compound (D) is contained, the [(C)/(B)] is, from the viewpoint of further easily exhibiting the effect of the present invention, preferably 0.05 or more, more preferably 0.06 or more, further preferably 0.07 or more by mass. The [(C)/(B)] is also preferably 0.16 or less.

The upper limits and the lower limits of the numerical ranges can be arbitrarily combined. Specifically, the [(C)/(B)] is preferably 0.05 to 0.16, more preferably 0.06 to 0.16, further preferably 0.07 to 0.16.

—Requirement (α2)—

In a lubricating oil composition of an aspect of the present invention, the requirement (α2) is defined as follows.

Requirement (α2): the phosphorus compound (D) and the zinc dithiophosphate (B) are contained at a ratio [(D)/(B)] of 1.04 or less by mass.

With a [(D)/(B)] in the above range, the effect of the present invention can be more easily exhibited.

Here, the [(D)/(B)] in the requirement (α2) is, from the viewpoint of easily preparing a lubricating oil composition more superior in the anti-seizure performance, preferably less than 1.04, more preferably 0.90 or less, further preferably 0.80 or less, furthermore preferably 0.70 or less by mass. Note that a lubricating oil composition that satisfies the requirement (α2) may not contain the phosphorus compound (D), and thus, the lower limit of [(D)/(B)] may be 0.00 by mass.

(Requirement (β))

In the lubricating oil composition of the present invention, the requirement (β) is defined as follows.

Requirement (β): when the content of the sarcosine compound (C) is 0.20% by mass or more and 0.40% by mass or less based on the entire amount of the lubricating oil composition, the phosphorus compound (D) is contained in an amount less than 0.50% by mass based on the entire amount of the lubricating oil composition.

In the lubricating oil composition of the present invention, the content of the sarcosine compound (C) is limited to more than 0.05% by mass and 0.40% by mass or less based on the entire amount of the lubricating oil composition. In the requirement (β), within the limited range, an aspect in the case of 0.20% by mass or more and 0.40% by mass or less is defined. When the definition is satisfied, even in the case where the requirement (α) is not satisfied, the effect of the present invention is exhibited.

Note that, in the requirement (β), the phosphorus compound (D) is inevitably contained in the lubricating oil composition. In the requirement (β), when the lubricating oil composition does not contain the phosphorus compound (D), the effect of the present invention is not exhibited. However, the content of the phosphorus compound (D) is limited to less than 0.50% by mass.

Here, the content of the sarcosine compound (C) in the requirement (β) is, from the viewpoint of easily preparing a lubricating oil composition more superior in the anti-seizure performance, preferably less than 0.40% by mass, more preferably 0.35% by mass or less, further preferably 0.30% by mass or less based on the entire amount of the lubricating oil composition.

The content of the phosphorus compound (D) in the requirement (β) is, from the viewpoint of more easily exhibiting the effect of the present invention, preferably 0.40% by mass or less, more preferably 0.35% by mass or less, further preferably 0.30% by mass or less. The content is also preferably 0.10% by mass or more, more preferably 0.15% by mass or more, further preferably 0.20% by mass or more.

The upper limits and the lower limits of the numerical ranges can be arbitrarily combined. Specifically, the content is preferably 0.10% by mass to 0.40% by mass, more preferably 0.15% by mass to 0.35% by mass, further preferably 0.20% by mass to 0.30% by mass.

Here, when a lubricating oil composition of an aspect of the present invention satisfies the requirement (β), from the viewpoint of more easily exhibiting the effect of the present invention, the lubricating oil composition more preferably satisfies any one of a requirement (β1) and a requirement (β2) explained below, and further preferably satisfies both the requirement (β1) and requirement β2) explained below.

—Requirement (β1)—

In a lubricating oil composition of an aspect of the present invention, the requirement (β1) is defined as follows.

Requirement (β1): the sarcosine compound (C) and the zinc dithiophosphate (B) are contained at a ratio [(C)/(B)] of 0.33 or less by mass.

With a [(C)/(B)] in the above range, the effect of the present invention can be more easily exhibited.

Here, the [(C)/(B)] in the requirement (β1) is, from the viewpoint of easily preparing a lubricating oil composition more superior in the anti-seizure performance, preferably less than 0.33, more preferably 0.30 or less, further preferably 0.27 or less, furthermore preferably 0.25 or less by mass. From the viewpoint of further easily exhibiting the effect of the present invention, the [(C)/(B)] is also preferably 0.10 or more, more preferably 0.15 or more, further preferably 0.17 or more.

The upper limits and the lower limits of the numerical ranges can be arbitrarily combined. Specifically, the [(C)/(B)] is preferably 0.10 or more and less than 0.33, more preferably 0.10 to 0.30, further preferably 0.15 to 0.27, furthermore preferably 0.17 to 0.25.

—Requirement (β2)—

In a lubricating oil composition of an aspect of the present invention, the requirement (β2) is defined as follows.

Requirement (β2): the phosphorus compound (D) and the zinc dithiophosphate (B) are contained at a ratio [(D)/(B)] of less than 0.42 by mass.

With a [(D)/(B)] in the above range, the effect of the present invention can be more easily exhibited.

Here, the [(D)/(B)] in the requirement (β2) is, from the viewpoint of more easily exhibiting the effect of the present invention, preferably 0.35 or less, more preferably 0.30 or less, further preferably 0.25 or less by mass. The [(D)/(B)] is also preferably 0.10 or more, more preferably 0.15 or more, further preferably 0.17 or more.

The upper limits and the lower limits of the numerical ranges can be arbitrarily combined. Specifically, the [(D)/(B)] is preferably 0.10 to 0.35, more preferably 0.15 to 0.30, further preferably 0.17 to 0.25.

<Base Oil (A)>

The lubricating oil composition of the present invention contains the base oil (A).

As the base oil (A), one or more selected from a mineral oil and a synthetic oil conventionally used as a base oil of a lubricating oil can be used with no limitation.

Examples of the mineral oil include an atmospheric distillation residual oil obtained by subjecting a crude oil, such as paraffin crude oil, intermediate base crude oil, or naphthene crude oil, to atmospheric distillation; a distillate obtained by subjecting the atmospheric distillation residual oil to reduced-pressure distillation; and a mineral oil obtained by subjecting the distillate to one or more refining treatments, such as solvent deasphalting, solvent extraction, hydrocracking, solvent dewaxing, catalytic dewaxing, and hydrorefining.

The mineral oil is preferably a mineral oil that is classified into Group 2 or 3 in the Base Oil Category of American Petroleum Institute (API).

Examples of the synthetic oil include a poly-α-olefin, such as an α-olefin homopolymer and an α-olefin copolymer (for example, an α-olefin copolymer having 8 to 14 carbon atoms, such as an ethylene-α-olefin copolymer); isoparaffin; various esters, such as a polyol ester and a dibasic acid ester; various ethers, such as polyphenyl ether; a polyalkylene glycol; an alkylbenzene; an alkylnaphthalene; and a GTL base oil obtained by isomerizing a wax (gas-to-liquid (GTL) wax) produced from natural gas by Fischer Tropsch process.

As the base oil (A), a mineral oil may be used alone or two or more mineral oils may be used in combination, or a synthetic oil may be used alone or two or more synthetic oils may be used in combination. One or more mineral oils and one or more synthetic oils may be used in combination.

Here, in a lubricating oil composition of an aspect of the present invention, the base oil (A) preferably contains a mineral oil. In this case, the content of the mineral oil based on the entire amount of the base oil (A) is preferably 50% by mass to 100% by mass, more preferably 60% by mass to 100% by mass, further preferably 70% by mass to 100% by mass, furthermore preferably 80% by mass to 100% by mass, still furthermore preferably 90% by mass to 100% by mass.

The base oil (A) preferably has a 100° C. kinematic viscosity of 1 $mm^2/s$ or more, more preferably 2 $mm^2/s$ or more, further preferably 3 $mm^2/s$ or more. The 100° C. kinematic viscosity of the base oil (A) is also preferably 25 $mm^2/s$ or less, more preferably 20 $mm^2/s$ or less, further preferably 15 $mm^2/s$ or less. The base oil (A) that has a 100° C. kinematic viscosity within the above range is advantageous from the viewpoints of, in addition to improving the brake squeal prevention performance, improving the seizure preventing performance and wear preventing performance of a transmission (gear), the viscosity characteristics, and the stability against oxidative degradation.

The upper limits and the lower limits of the numerical ranges can be arbitrarily combined. Specifically, the 100° C. kinematic viscosity is preferably 1 $mm^2/s$ to 25 $mm^2/s$, more preferably 2 $mm^2/s$ to 20 $mm^2/s$, further preferably 3 $mm^2/s$ to 25 $mm^2/s$.

The base oil (A) preferably has a viscosity index of 100 or more, more preferably 110 or more, further preferably 120 or more. The base oil (A) that has a viscosity index within the above range is advantageous from the viewpoints of, in addition to improving the brake squeal prevention performance, improving the seizure preventing performance and wear preventing performance of a transmission (gear), the viscosity characteristics, and the stability against oxidative degradation.

When the base oil (A) is a mixture base oil containing two or more base oils, the 100° C. kinematic viscosity and the viscosity index of the mixture base oil is preferably within the above range.

As used herein, the 100° C. kinematic viscosity and the viscosity index of the base oil (A) mean values measured or calculated according to JIS K 2283:2000.

(Content of Base Oil (A))

In a lubricating oil composition of an aspect of the present invention, the content of the base oil (A) is preferably 95% by mass or less based on the entire amount of the lubricating oil composition. When the content of the base oil (A) is 95% by mass or less, the amounts of the zinc dithiophosphate (B) and the sarcosine compound (C), and further, the phosphorus compound (D), blended in the lubricating oil composition can be sufficiently ensured and thus the effect of the present invention can be easily exhibited.

The content of the base oil (A) is, from the viewpoint of more easily exhibiting the effect of the present invention, more preferably 93% by mass or less, further preferably 92% by mass or less based on the entire amount of the lubricating oil composition. The content is also preferably 65% by mass or more, more preferably 70% by mass or more, further preferably 75% by mass or more.

The upper limits and the lower limits of the numerical ranges can be arbitrarily combined. Specifically, the content is preferably 65% by mass to 95% by mass, more preferably 70% by mass to 93% by mass, further preferably 75% by mass to 92% by mass.

Note that a lubricating oil composition of an aspect of the present invention sometimes contains a viscosity index enhancer or other additives as described later, and in some cases, the additives are provided in a state diluted in a diluting oil and are blended in the lubricating oil composition in the state diluted in the diluting oil. In such a case, the diluting oil is included in the content of the base oil (A).

<Zinc Dithiophosphate (B)>

The lubricating oil composition of the present invention contains the zinc dithiophosphate (B).

When the lubricating oil composition does not contain the zinc dithiophosphate (B), the effect of the present invention (in particular, the anti-seizure performance) is not exhibited.

As the zinc dithiophosphate (B), those conventionally broadly used as an additive of the lubricating oil can be used with no particular limitation. As the zinc dithiophosphate (B), one compound can be used alone or two or more compounds can be used in combination.

In a lubricating oil composition of an aspect of the present invention, as the zinc dithiophosphate (B), from the viewpoint of more easily exhibiting the effect of the present invention, a compound represented by the following general formula (b-1) is preferably used.

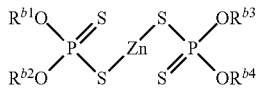

(b-1)

In the general formula (b-1), $R^{b1}$ to $R^{b4}$ each independently represent a hydrocarbon group.

The hydrocarbon group selected as $R^{b1}$ to $R^{b4}$ is not particularly limited as long as it is a monovalent hydrocarbon group, and preferred examples thereof include an alkyl group, an alkenyl group, a cycloalkyl group, and an aryl group, and an alkyl group and an aryl group are more preferred, and an alkyl group is further preferred.

In other words, the zinc dithiophosphate (B) used in a lubricating oil composition of an aspect of the present invention is more preferably a zinc dialkyldithiophosphate or a zinc diaryldithiophosphate, and further preferably a zinc dialkyldithiophosphate.

The alkyl group and alkenyl group selected as $R^{b1}$ to $R^{b4}$ may be linear or branched.

When $R^{b1}$ to $R^{b4}$ are an alkyl group, the zinc dithiophosphate (B) may be a primary zinc dialkyldithiophosphate in which $R^{b1}$ to $R^{b4}$ are a primary alkyl group or may be a secondary zinc dialkyldithiophosphate in which $R^{b1}$ to $R^{b4}$ are a secondary alkyl group, but from the viewpoint of the stability of the zinc dithiophosphate (B), a primary zinc dialkyldithiophosphate is preferably used.

Note that the cycloalkyl group and aryl group which may be selected as $R^{b1}$ to $R^{b4}$ may be, for example, a polycyclic group, such as a decalyl group or a naphthyl group.

The monovalent hydrocarbon group which may be selected as $R^{b1}$ to $R^{b4}$ may have a substituent containing an oxygen atom and/or a nitrogen atom, such as a hydroxy group, a carboxy group, an amino group, an amido group, a nitro group, or a cyano group, or may be partially substituted by a nitrogen atom, an oxygen atom, a halogen atom, or the like.

The number of carbon atoms of the hydrocarbon group which may be selected as $R^{b1}$ to $R^{b4}$ is, when the monovalent hydrocarbon group is an alkyl group, preferably 1 or more, more preferably 2 or more, further preferably 3 or more, and, as the upper limit, is preferably 24 or less, more preferably 18 or less, further preferably 12 or less.

When the monovalent hydrocarbon is an alkenyl group, the number of carbon atoms is preferably 2 or more, more preferably 3 or more, and, as the upper limit, is preferably 24 or less, more preferably 18 or less, further preferably 12 or less.

When the monovalent hydrocarbon is a cycloalkyl group, the number of carbon atoms is preferably 5 or more, and, as the upper limit, is preferably 20 or less. When the monovalent hydrocarbon is an aryl group, the number of carbon atoms is preferably 6 or more, and, as the upper limit, is preferably 20 or less.

As the compound represented by the following general formula (b-1), one compound may be used alone or two or more compounds may be used in combination.

(Content of Zinc Dithiophosphate (B))

In a lubricating oil composition of an aspect of the present invention, the content of the zinc dithiophosphate (B) is, from the viewpoint of easily exhibiting the effect of the present invention, based on the entire amount of the lubricating oil composition, preferably 0.50% by mass or more, more preferably 0.80% by mass or more, further preferably 1.00% by mass or more, furthermore preferably 1.10% by mass or more. The content is also preferably 2.00% by mass or less, more preferably 1.60% by mass or less, further preferably 1.40% by mass or less, further preferably 1.30% by mass or less.

The upper limits and the lower limits of the numerical ranges can be arbitrarily combined. Specifically, the content is preferably 0.50% by mass to 2.00% by mass, more preferably 0.80% by mass to 1.60% by mass, further preferably 1.00% by mass to 1.40% by mass, furthermore preferably 1.10% by mass to 1.30% by mass.

<Sarcosine Compound (C)>

The lubricating oil composition of the present invention contains the sarcosine compound (C).

The lubricating oil composition of the present invention is, by containing the sarcosine compound (C) and satisfying the requirement (α) or the requirement (β) described later, superior both in the brake squeal prevention performance and in the anti-seizure performance. When the lubricating oil composition does not contain the sarcosine compound (C), the effect of the present invention (in particular, the brake squeal prevention performance) is not exhibited.

As the sarcosine compound (C), one compound may be used alone or two or more compounds may be used in combination.

In a lubricating oil composition of an aspect of the present invention, as the sarcosine compound (C), from the viewpoint of more easily exhibiting the effect of the present invention, a sarcosine compound (C1) represented by the following general formula (c-1) is preferably used.

(c-1)

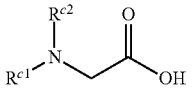

In the general formula (c-1), $R^{c1}$ represents a hydrocarbon group having 2 to 30 carbon atoms and optionally containing a heteroatom, and $R^{c2}$ represents a hydrogen atom or a methyl group.

The hydrocarbon group which may be selected as $R^{c1}$ is not particularly limited as long as it is a monovalent hydrocarbon group, and examples thereof include an alkyl group having 2 to 30 carbon atoms, a cycloalkyl group having 3 to 30 carbon atoms, and an alkenyl group having 3 to 30 carbon atoms. The monovalent hydrocarbon groups may contain a heteroatom. Specifically, the monovalent hydrocarbon groups may have a substituent containing an oxygen atom and/or a nitrogen atom, such as a hydroxy group, a carboxy group, an amino group, an amido group, a nitro group, or a cyano group, or may be partially substituted by a nitrogen atom, an oxygen atom, a halogen atom, or the like.

The number of carbon atoms of the hydrocarbon group which may be selected as $R^{c1}$ is preferably 8 to 26, more preferably 12 to 24, and further preferably 16 to 20. $R^{c1}$ is preferably an alkyl group and an alkenyl group optionally having a substituent, and more preferably an alkenyl group optionally having a substituent.

Examples of the alkyl group optionally having a substituent which may be selected as $R^{c1}$ include an ethyl group, a propyl group, a butyl group, a pentyl group, a hexyl group, a heptyl group, an octyl group, a nonyl group, a decyl group, an undecyl group, a dodecyl group, a tridecyl group, a tetradecyl group, a hexadecyl group, an octadecyl group, a tetracosyl group, and a hexacosyl group. The alkyl group may be a linear alkyl group or may be a branched alkyl group.

Examples of the cycloalkyl group optionally having a substituent which may be selected as $R^{c1}$ include a cyclopropyl group, a cyclobutyl group, a cyclopentyl group, a cyclohexyl group, a cycloheptyl group, a cyclooctyl group, and an adamantyl group. The cycloalkyl group may be substituted with an alkyl group having 1 to 10 (preferably 1 to 4) carbon atoms.

Examples of the alkenyl group optionally having a substituent which may be selected as $R^{c1}$ include a propenyl group, a butenyl group, a pentenyl group, a hexenyl group, a heptenyl group, an octenyl group, a nonenyl group, a decenyl group, an undecenyl group, a dodecenyl group, a tridecenyl group, a tetradecenyl group, a hexadecenyl group, an octadecenyl group, a tetracosenyl group, and a hexacosenyl group. The alkenyl group may be a linear alkenyl group or a branched alkenyl group.

As the sarcosine compound (C1), one compound may be used alone or two or more compounds may be used in combination.

Here, in a lubricating oil composition of an aspect of the present invention, as the sarcosine compound (C1), from the viewpoint of further easily exhibiting the effect of the present invention, a sarcosine compound (C2) represented by the following general formula (c-2) is more preferably used.

(c-2)

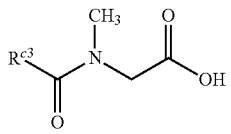

[In the general formula (c-2), $R^{C3}$ represents a hydrocarbon group having 1 to 29 carbon atoms.]

The hydrocarbon group which may be selected as $R^{C3}$ is not particularly limited as long as it is a monovalent hydrocarbon group, and examples thereof include an alkyl group having 1 to 29 carbon atoms, a cycloalkyl group having 3 to 29 carbon atoms, and an alkenyl group having 3 to 29 carbon atoms.

The number of carbon atoms of the hydrocarbon group which may be selected as $R^{C3}$ is preferably 7 to 25, more preferably 11 to 23, further preferably 15 to 19. $R^{C3}$ is preferably an alkyl group or an alkenyl group, more preferably an alkenyl group.

Examples of the alkyl group, cycloalkyl group, and alkenyl group which may be selected as $R^{C3}$ include the same groups as the groups exemplified as Ra.

A specific preferred example of the sarcosine compound (C2) represented by the general formula (c-2) is N-oleoyl sarcosine ($R^{C3}$ is an alkenyl group having 17 carbon atoms).

As the sarcosine compound (C2), one compound may be used alone or two or more compounds may be used in combination.

(Content of Sarcosine Compound (C))

In the lubricating oil composition of the present invention, the content of the sarcosine compound (C) based on the entire amount of the lubricating oil composition is more than 0.05% by mass and 0.40% by mass or less.

When the content of the sarcosine compound (C) is 0.05% by mass or less, a good brake squeal prevention performance can not be achieved.

When the content of the sarcosine compound (C) is more than 0.40% by mass, a good anti-seizure performance can not be achieved.

Here, from the viewpoint of easily achieving a good brake squeal prevention performance, the content of the sarcosine compound (C) based on the entire amount of the lubricating oil composition is preferably 0.07% by mass or more, more preferably 0.08% by mass or more, further preferably 0.09% by mass or more, furthermore preferably 0.10% by mass or more.

From the viewpoint of achieving a good anti-seizure performance, the content of the sarcosine compound (C)

based on the entire amount of the lubricating oil composition is preferably less than 0.40% by mass, more preferably 0.35% by mass or less, further preferably 0.30% by mass or less.

The upper limits and the lower limits of the numerical ranges can be arbitrarily combined. Specifically, the content is preferably 0.07% by mass or more and less than 0.40% by mass, more preferably 0.08% by mass or more and less than 0.40% by mass, further preferably 0.09% by mass to 0.35% by mass, furthermore preferably 0.10% by mass to 0.30% by mass.

<Phosphorus Compound (D)>

The lubricating oil composition of the present invention, when satisfying the requirement (α), optionally contains one or more phosphorus compounds (D) selected from the group consisting of an acidic phosphoric acid ester (D1) and an amine salt thereof (D2).

The lubricating oil composition of the present invention, when satisfying the requirement (β), contains the phosphorus compound (D).

As described hereinabove, by blending one or more phosphorus compounds (D) selected from the group consisting of an acidic phosphoric acid ester (D1) and an amine salt thereof (D2) in a lubricating oil composition, the range of the content of the sarcosine compound (C) that provides both a good brake squeal prevention performance and a good anti-seizure performance can be expanded. In other words, in such a range of the content of the sarcosine compound (C) of 0.20% by mass or more and 0.40% by mass or less as defined by the requirement (β), a good brake squeal prevention performance and a good anti-seizure performance can not both be achieved by only the sarcosine compound (C), but when the content of the sarcosine compound (C) is within the above range, by blending a specific amount of the phosphorus compound (D), a good brake squeal prevention performance and a good anti-seizure performance can both be achieved.

Note that the zinc dithiophosphate (B) is not included in the phosphorus compound (D).

In a lubricating oil composition of an aspect of the present invention, as the acidic phosphoric acid ester (D1) used as the phosphorus compound (D), from the viewpoint of more easily exhibiting the effect of the present invention, a compound represented by the following general formula (d-1) is preferably used.

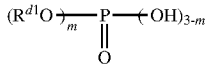

(d-1)

In the general formula (d-1), $R^{d1}$'s each independently represent a hydrocarbon group having 1 to 30 carbon atoms. Preferred examples of the hydrocarbon group include, from the viewpoint of achieving more superior wear resistance, an alkyl group, an alkenyl group, an aryl group, and an arylalkyl group.

When $R^{d1}$ is an alkyl group, from the viewpoint of achieving more superior wear resistance, furthermore, also in view of the availability and the like, the number of carbon atoms thereof is preferably 2 to 20. The alkyl group may be linear, branched, or cyclic, and furthermore, in view of the availability and the like, the alkyl group is preferably linear or branched.

When $R^{d1}$ is an alkenyl group, from the viewpoint of achieving more superior wear resistance, furthermore, also in view of the availability and the like, the number of carbon atoms thereof is preferably 2 to 20. The alkenyl group may be linear, branched, or cyclic, and is preferably linear or branched.

When $R^{d1}$ is an aryl group, from the viewpoint of achieving more superior seizure resistance and wear resistance, furthermore, also in view of the availability and the like, the number of carbon atoms thereof is preferably 6 to 20, more preferably 6 to 15.

When $R^{d1}$ is an arylalkyl group, from the viewpoint of achieving more superior seizure resistance and wear resistance, furthermore, also in view of the availability and the like, the number of carbon atoms thereof is preferably 6 to 20, more preferably 6 to 15.

In the general formula (d-1), m is 1 or 2.

When m=2, multiple $R^{d1}$'s may be the same as or different from each other.

Examples of the acidic phosphoric acid ester represented by the general formula (d-1) include mono(di)ethyl acid phosphate, mono(di)-n-propyl acid phosphate, mono(di)-2-ethylhexyl acid phosphate, mono(di)butyl acid phosphate, mono(di)octyl acid phosphate, mono(di)dodecyl acid phosphate, mono(di)oleyl acid phosphate, mono(di)isodecyl acid phosphate, mono(di)lauryl acid phosphate, mono(di)stearyl acid phosphate, and mono(di)isostearyl acid phosphate.

As the compound represented by the general formula (d-1), one compound may be used alone or two or more compounds may be used in combination.

A preferred example of the acidic phosphoric acid ester amine salt (D2) is an amine salt formed from the acidic phosphoric acid ester (D1) and an amine. Here, examples of the amine used for forming the amine salt include a primary amine, a secondary amine, a tertiary amine, and a polyalkylene amine, and examples of the primary amine, the secondary amine, and the tertiary amine includes amines represented by the following general formula (d-2).

$$R^{d2}_{n}-NH_{3-n} \quad \text{(d-2)}$$

In the general formula (d-2), $R^{d2}$ represents a hydrocarbon group having 1 to 30 carbon atoms. When the hydrocarbon group is an alkyl group, the alkyl group includes a hydroxyalkyl group obtained by substituting at least one of the hydrogen atoms of the alkyl group with a hydroxy group.

$R^{d2}$ is preferably an alkyl group having 6 to 18 carbon atoms, an alkenyl group having 6 to 18 carbon atoms, an aryl group having 6 to 18 ring carbon atoms, an arylalkyl group having 7 to 18 carbon atoms, or a hydroxyalkyl group having 6 to 18 carbon atoms, and among them, an alkyl group having 6 to 18 carbon atoms is more preferred.

In addition, n is 1, 2, or 3. The amine is a primary amine when n is 1, the amine is a secondary amine when n is 2, and the amine is a tertiary amine when n is 3.

Examples of the polyalkylene amine include ethylenediamine, diethylenetriamine, triethylenetetramine, tetraethylenepentamine, pentaethylenehexamine, hexaethyleneheptamine, heptaethyleneoctamine, tetrapropylenepentamine, and hexabutyleneheptamine.

As the amine salt of the acidic phosphoric acid ester (D1) and the amine represented by the general formula (d-2) or the polyamine, one compound may be used alone or two or more compounds may be used in combination.

(Content of Phosphorus Compound (D))

When a lubricating oil composition of an aspect of the present invention satisfies the requirement (α), the content of the phosphorus compound (D) is, from the viewpoint of more easily exhibiting the effect of the present invention, based on the entire amount of the lubricating oil composition, preferably 0.05% by mass or more, more preferably 0.10% by mass or more, further preferably 0.13% by mass or more. The content is also preferably 1.25% by mass or less, more preferably less than 1.25% by mass, further preferably 1.00% by mass or less.

The upper limits and the lower limits of the numerical ranges can be arbitrarily combined. Specifically, the content is preferably 0.05% by mass or more and 1.25% by mass or less, more preferably 0.10% by mass or more and less than 1.25% by mass, further preferably 0.13% by mass or more and 1.00% by mass or less.

When a lubricating oil composition of an aspect of the present invention satisfies the requirement (β), the content of the phosphorus compound (D) is as defined in the requirement (β), and the suitable range is also the same as the suitable range described for the requirement (β).

<Other Requirements>

When a lubricating oil composition of an aspect of the present invention satisfies the requirement (α), the ratio [(D)/(C)] of the phosphorus compound (D) to the sarcosine compound (C) contained is, from the viewpoint of more easily exhibiting the effect of the present invention, preferably more than 0.50, more preferably 1.10 or more, further preferably 1.30 or more by mass. The ratio [(D)/(C)] is also preferably 12.5 or less, more preferably less than 12.5, further preferably 10.0 or less.

The upper limits and the lower limits of the numerical ranges can be arbitrarily combined. Specifically, the ratio [(D)/(C)] is preferably 0.50 or more and 12.5 or less, more preferably 1.10 or more and less than 12.5, further preferably 1.30 or more and 10.0 or less.

When a lubricating oil composition of an aspect of the present invention satisfies the requirement (β), the ratio [(D)/(C)] of the phosphorus compound (D) to the sarcosine compound (C) contained is, from the viewpoint of more easily exhibiting the effect of the present invention, preferably 0.40 or more, more preferably 0.50 or more, further preferably 0.55 or more, furthermore preferably 0.65 or more, still furthermore preferably 0.70 or more by mass. The ratio [(D)/(C)] is also preferably less than 1.67, more preferably 1.40 or less, further preferably 1.30 or less.

The upper limits and the lower limits of the numerical ranges can be arbitrarily combined. Specifically, the ratio [(D)/(C)] is preferably 0.40 or more and less than 1.67, more preferably 0.50 or more and 1.40 or less, further preferably 0.55 or more and 1.30 or less, furthermore preferably 0.65 or more and 1.30 or less, still furthermore preferably 0.70 or more and 1.30 or less.

<Other Additives>

A lubricating oil composition of an aspect of the present invention may contain additives other than the component (A) to the component (D) (hereinafter also referred to as "other additives") to the extent that the effect of the present invention is not largely impaired.

Examples of the other additives include an antioxidant, a friction modifier, an oily agent, a corrosion inhibitor (metal deactivator), a detergent, a dispersant, a viscosity index improver, a pour point depressant, an anti-foaming agent, a rust inhibitor, and an extreme pressure agent. One of the additives may be used alone or two or more thereof may be used in combination.

The total content of the other additives based on the entire amount of the lubricating oil composition is preferably 0% by mass or more and 25% by mass or less, more preferably 0% by mass or more and 20% by mass or less, further preferably 0% by mass or more and 16% by mass or less.

(Antioxidant)

Examples of the antioxidant include an amine-based antioxidant, such as a monoalkyldiphenylamine having an alkyl group having about 3 to 10 carbon atoms, for example, mono-t-butyldiphenylamine; a dialkyldiphenylamine in which each alkyl group has about 3 to 10 carbon atoms, for example, 4,4'-dibutyl diphenylamine; a polyalkyldiphenylamine having 3 or more alkyl groups in which each alkyl group has about 1 to 10 carbon atoms, for example, tetrabutyldiphenylamine; a phenyl-α-naphthylamine, for example, an alkyl-substituted phenyl-α-naphthylamine having at least one alkyl group having about 1 to 12 carbon atoms, such as methylphenyl-α-naphthylamine, or phenyl-α-naphthylamine; or a mono-hindered amine-based antioxidant, for example, 2,2,6,6-tetramethylpyperidinylmethacrylate, and a phenol-based antioxidant, such as a bisphenol-based antioxidant, for example, 4,4'-methylene bis(2,6-di-t-butylphenol) bis(3-methyl-4-hydroxy-5-t-butylbenzyl) sulfide; or a monophenol-based antioxidant, for example, 2,6-di-t-butyl-4-methylphenol or n-octadecyl-3-(4-hydroxy-3,5-di-t-butyl phenyl)propionate.

One of the antioxidants may be used alone or two or more thereof may be used in combination.

(Friction Modifier)

Examples of the friction modifier include ashless friction modifiers, such as an aliphatic amine, a fatty acid ester, a fatty acid amide, a fatty acid, an aliphatic alcohol, and an aliphatic ether that have at least one alkyl group or alkenyl group having 6 to 30 carbon atoms in a molecule.

One of the friction modifiers may be used alone or two or more thereof may be used in combination.

(Oily Agent)

Examples of the oily agent include an aliphatic alcohol; a fatty acid compound, such as a fatty acid or a fatty acid metal salt; an ester compound, such as a polyol ester, a sorbitan ester, or a glyceride; and an amine compound, such as an aliphatic amine.

One of the oily agents may be used alone or two or more thereof may be used in combination.

(Corrosion Inhibitor (Metal Deactivator))

Examples of the corrosion inhibitor (metal deactivator) include a benzotriazole compound, a tolyltriazole compound, an imidazole compound, and a pyrimidine compound.

One of the corrosion inhibitors may be used alone or two or more thereof may be used in combination.

(Detergent)

Examples of the detergent include metal-based detergents, such as a salicylate, sulfonate, and phenate of sodium, potassium, or magnesium.

One of the detergents may be used alone or two or more thereof may be used in combination.

(Dispersant)

Examples of the dispersant include ashless dispersants, such as a boron-free succinic acid imide, a boron-containing succinic acid imide, a benzylamine, a boron-containing benzylamine, a succinic acid ester, and an amide of a monobasic or dibasic carboxylic acid typified by a fatty acid or succinic acid.

One of the dispersants may be used alone or two or more thereof may be used in combination.

(Viscosity Index Improver)

Examples of the viscosity index improver include a non-dispersant-type polymethacrylate (PMA), a dispersant-type polymethacrylate, an olefin-based copolymer (olefin copolymer (OCP); for example, ethylene-propylene copolymer), a dispersant-type olefinic copolymer, and a styrene-based copolymer (for example, styrene-diene hydrogenated copolymer).

One of the viscosity index improvers may be used alone or two or more thereof may be used in combination.

Here, as the viscosity index improver, a non-dispersant-type polymethacrylate (PMA) is preferably used.

As the non-dispersant-type polymethacrylate (PMA), two or more kinds having different mass average molecular weights (Mw) in the range of preferably 10,000 to 300,000 each are preferably used in combination.

The mass average molecular weight (Mw) of the viscosity index improver is a value measured by gel permeation chromatography and calculated based on polystyrene.

(Pour Point Depressant)

Examples of the pour point depressant include an ethylene-vinyl acetate copolymer, a condensate of chlorinated paraffin and naphthalene, a condensate of chlorinated paraffin and phenol, a polymer, such as polymethacrylate or polyalkylstyrene. The weight average molecular weights (Mw) of the polymers are preferably 50,000 to 150,000.

(Anti-Foaming Agent)

Examples of the anti-foaming agent include a silicone-based anti-foaming agent, such as a silicone oil or a fluorosilicone oil, and a fluorinated anti-foaming agent, such as a fluoroalkyl ether.

One of the anti-foaming agents may be used alone or two or more thereof may be used in combination.

(Rust Inhibitor)

Examples of the rust inhibitor include petroleum sulfonate, an alkylbenzene sulfonate, dinonylnaphthalene sulfonate, an alkenylsuccinic acid ester, and a polyhydric alcohol ester.

One of the rust inhibitors may be used alone or two or more thereof may be used in combination.

(Extreme Pressure Agent)

Examples of the extreme pressure agent include sulfur-based extreme pressure agents, such as sulfurized olefins, hydrocarbyl sulfides, sulfurized oils and fats, sulfurized fatty acids, and sulfurized esters; phosphorus-based extreme pressure agents other than the phosphorus compound (D), such as phosphoric acid ester compounds, for example, a phosphoric acid ester, a phosphorous acid ester, or a hydrogen phosphite ester, and an amine salt of the phosphoric acid ester compound; extreme pressure agents containing a sulfur atom and a phosphorus atom, such as a monothiolphosphoric acid ester, a dithiophosphoric acid ester, a trithiophosphoric acid ester, an amine base of a monothiolphosphoric acid ester, an amine salt of a dithiophosphoric acid ester, a monothiolphosphorous acid ester, a dithiophosphorous acid ester, and a trithiophosphorous acid ester.

One of the extreme pressure agents may be used alone or two or more thereof may be used in combination.

However, from the viewpoint of exhibiting the effect of addition of the phosphorus compound (D) as much as possible, the content of one or more extreme pressure agents selected from a phosphorus-based extreme pressure agent other than the phosphorus compound (D) and the extreme pressure agent containing a sulfur atom and a phosphorus atom is preferably lower.

Specifically, the content of the phosphorus-based extreme pressure agent other than the phosphorus compound (D) and the content of the extreme pressure agent containing a sulfur atom and a phosphorus atom are preferably each independently less than 0.01% by mass, more preferably less than 0.005% by mass, further preferably less than 0.001% by mass, and furthermore preferably, one or both of such extreme pressure agents are not contained.

[Physical Properties of Lubricating Oil Composition]

<40° C. Kinematic Viscosity, 100° C. Kinematic Viscosity, Viscosity Index>

A lubricating oil composition of an aspect of the present invention has a 40° C. kinematic viscosity of preferably 10 $mm^2/s$ or more, more preferably 20 $mm^2/s$ or more, further preferably 30 $mm^2/s$ or more, and preferably 70 $mm^2/s$ or less, more preferably 60 $mm^2/s$ or less, further preferably 50 $mm^2/s$ or less.

The upper limits and the lower limits of the numerical ranges can be arbitrarily combined. Specifically, the 40° C. kinematic viscosity is preferably 10 $mm^2/s$ or more and 70 $mm^2/s$ or less, more preferably 20 $mm^2/s$ or more and 60 $mm^2/s$ or less, further preferably 30 $mm^2/s$ or more and 50 $mm^2/s$ or less.

A lubricating oil composition of an aspect of the present invention has a 100° C. kinematic viscosity of preferably 5.0 $mm^2/s$ or more, more preferably 6.0 $mm^2/s$ or more, further preferably 6.5 $mm^2/s$ or more, furthermore preferably 7.0 $mm^2/s$ or more, and preferably 11 $mm^2/s$ or less, more preferably 10 $mm^2/s$ or less, further preferably 9.0 $mm^2/s$ or less.

The upper limits and the lower limits of the numerical ranges can be arbitrarily combined. Specifically, the 100° C. kinematic viscosity is preferably 5.0 $mm^2/s$ or more and 11 $mm^2/s$ or less, more preferably 6.0 $mm^2/s$ or more and 10 $mm^2/s$ or less, further preferably 6.5 $mm^2/s$ or more and 9.0 $mm^2/s$ or less, furthermore preferably 7.0 $mm^2/s$ or more and 9.0 $mm^2/s$ or less.

A lubricating oil composition of an aspect of the present invention has a viscosity index of preferably 180 or more, more preferably 190 or more, further preferably 200 or more.

When the kinematic viscosity and viscosity index of the lubricating oil composition are within the above ranges, in addition to the brake squeal prevention performance and anti-seizure performance, the wear preventing performance, viscosity characteristics, and the like are also easily improved.

The measurement methods of the 40° C. kinematic viscosity, 100° C. kinematic viscosity, and viscosity index of a lubricating oil composition are the same as for the base oil (A).

<Base Number>

A lubricating oil composition of an aspect of the present invention has a base number of preferably 4 mgKOH/g or more, preferably 5 mgKOH/g or more, preferably 6 mgKOH/g or more. The base number is also generally 12 mgKOH/g or less.

A lubricating oil composition that has a base number within the above range is advantageous from the viewpoints of improving the detergent dispersibility, the stability against oxidative degradation, and the like.

The base number of the lubricating oil composition is a value measured by a potentiometric method (hydrochloric acid method) according to JIS K2501:2003.

<Contents of Various Atoms>

From the viewpoint of more easily exhibiting the effect of the present invention, a lubricating oil composition of an aspect of the present invention preferably has contents of various atoms in the following range.

Note that the contents of calcium atoms, phosphorus atoms, zinc atoms, and sulfur atoms in the lubricating oil composition are values measured according to JIS-5S-38-03.

The content of nitrogen atoms in the lubricating oil composition is a value measured according to JIS K2609: 1998.

(Calcium Atom Content)

A lubricating oil composition of an aspect of the present invention has a calcium atom content based on the entire amount of the lubricating oil composition of preferably 5,000 ppm by mass or less, more preferably 4,500 ppm by mass or less, further preferably 4,200 ppm by mass or less. The content is also preferably 2,500 ppm by mass or more, more preferably 3,000 ppm by mass or more, further preferably 3,500 ppm by mass or more.

The upper limits and the lower limits of the numerical ranges can be arbitrarily combined. Specifically, the content is preferably 2,500 ppm by mass or more and 5,000 ppm by mass or less, more preferably 3,000 ppm by mass or more and 4,500 ppm by mass or less, further preferably 3,500 ppm by mass or more and 4,200 ppm by mass or less.

(Phosphorus Atom Content)

A lubricating oil composition of an aspect of the present invention has a phosphorus atom content based on the entire amount of the lubricating oil composition of preferably 2,000 ppm by mass or less, more preferably 1,500 ppm by mass or less, further preferably 1,300 ppm by mass or less. The content is also preferably 500 ppm by mass or more, more preferably 700 ppm by mass or more, further preferably 800 ppm by mass or more.

The upper limits and the lower limits of the numerical ranges can be arbitrarily combined. Specifically, the content is preferably 500 ppm by mass or more and 2,000 ppm by mass or less, more preferably 700 ppm by mass or more and 1,500 ppm by mass or less, further preferably 800 ppm by mass or more and 1,300 ppm by mass or less.

(Zinc Atom Content)

A lubricating oil composition of an aspect of the present invention has a zinc atom content based on the entire amount of the lubricating oil composition of preferably 2,000 ppm by mass or less, more preferably 1,500 ppm by mass or less, further preferably 1,200 ppm by mass or less. The content is also preferably 500 ppm by mass or more, more preferably 800 ppm by mass or more, further preferably 1,000 ppm by mass or more.

The upper limits and the lower limits of the numerical ranges can be arbitrarily combined. Specifically, the content is preferably 500 ppm by mass or more and 2,000 ppm by mass or less, more preferably 800 ppm by mass or more and 1,500 ppm by mass or less, further preferably 1,000 ppm by mass or more and 1,200 ppm by mass or less.

(Sulfur Atom Content)

A lubricating oil composition of an aspect of the present invention has a sulfur atom content based on the entire amount of the lubricating oil composition of preferably 0.30% by mass or less, more preferably 0.25% by mass or less, further preferably 0.23% by mass or less. The content is also preferably 0.10% by mass or more, more preferably 0.15% by mass or more, further preferably 0.20% by mass or more.

The upper limits and the lower limits of the numerical ranges can be arbitrarily combined. Specifically, the content is preferably 0.10% by mass or more and 0.30% by mass or less, more preferably 0.15% by mass or more and 0.25% by mass or less, further preferably 0.20% by mass or more and 0.23% by mass or less.

(Nitrogen Atom Content)

A lubricating oil composition of an aspect of the present invention has a nitrogen atom content based on the entire amount of the lubricating oil composition of preferably 1,200 ppm by mass or less, more preferably 900 ppm by mass or less, further preferably 700 ppm by mass or less. The content is also preferably 250 ppm by mass or more, more preferably 300 ppm by mass or more, further preferably 350 ppm by mass or more.

The upper limits and the lower limits of the numerical ranges can be arbitrarily combined. Specifically, the content is preferably 250 ppm by mass or more and 1,200 ppm by mass or less, more preferably 300 ppm by mass or more and 900 ppm by mass or less, further preferably 350 ppm by mass or more and 700 ppm by mass or less.

<Coefficient of Friction $\mu_{50}$>

A lubricating oil composition of an aspect of the present invention has a coefficient of friction $\mu_{50}$ at 80° C., which is measured based on JASO M 349:2012 using a low velocity slipping friction apparatus (LVFA tester) under conditions as in Examples described later, of preferably less than 0.115, more preferably 0.114 or less, further preferably 0.113 or less, furthermore preferably 0.112 or less, still furthermore preferably 0.111 or less.

<Load Withstanding Capacity>

A lubricating oil composition of an aspect of the present invention has a load withstanding capacity (anti-seizure performance), which is measured under conditions as in Examples described later, of preferably more than 0.50 MPa, more preferably 0.55 MPa or more, further preferably more than 0.55 MPa, furthermore preferably 0.60 MPa or more.

[Method of Producing Lubricating Oil Composition]

The method of producing the lubricating oil composition of the present invention is not particularly limited, but, for example, a production method as explained below is exemplified.

Specifically, an example is a method of producing the lubricating oil composition, the method including a step (S1) of blending the base oil (A), the zinc dithiophosphate (B), and the sarcosine compound (C), the content of the sarcosine compound (C) being adjusted in the range of more than 0.05% by mass and 0.40% by mass or less based on the entire amount of the lubricating oil composition so as to satisfy the requirement (α) or (β).

Requirement (S1α): when the amount of the sarcosine compound (C) blended is adjusted to more than 0.05% by mass and less than 0.20% by mass based on the entire amount of the lubricating oil composition, one or more phosphorus compounds (D) selected from the group consisting of an acidic phosphoric acid ester (D1) and an amine salt thereof (D2) are optionally blended.

Requirement (S1β): when the amount of the sarcosine compound (C) blended is adjusted to 0.20% by mass or more and 0.40% by mass or less based on the entire amount of the lubricating oil composition, the phosphorus compound (D) is blended in an amount less than 0.50% by mass based on the entire amount of the lubricating oil composition.

The order of blending the above components is not particularly limited, and, for example, the zinc dithiophosphate (B), the sarcosine compound (C), the phosphorus compound (D), and further other additives may be blended in this order to the base oil (A), or two or more selected from the zinc dithiophosphate (B), the sarcosine compound (C), the phosphorus compound (D), and other additives may be mixed in advance before blending.

[Application of Lubricating Oil Composition]

The lubricating oil composition of the present invention is superior both in the brake squeal prevention performance and in the anti-seizure performance. Thus, the lubricating oil composition is suitably used for industrial machines. In addition, among industrial machines, when commonly lubricating an industrial machine provided with a transmission (gear), a hydraulically actuated part, and a wet brake, for example, an agricultural machine, such as a tractor, a rice planting machine, a binder, or a combine, a construction machine, such as a hydraulic power shovel, a truck-mounted crane, or a bulldozer, or a transporting machine, such as a dump truck, a forklift, a shovel loader, or a rough terrain hauler, the seizure of the transmission (gear) can be prevented while preventing squeal of the wet brake. Accordingly, the lubricating oil composition is suitably used in such an application.

[Lubrication Method]

The lubrication method of the present invention is a lubrication method using the lubricating oil composition of the present invention.

The lubricating oil composition of the present invention is superior both in the brake squeal prevention performance and in the anti-seizure performance. Thus, the lubrication method of the present invention enables effective utilization of the aforementioned performances of the lubricating oil composition of the present invention, and is thus suitably used for industrial machines. Among industrial machines, when commonly lubricating an industrial machine provided with a transmission (gear), a hydraulically actuated part, and a wet brake, for example, an agricultural machine, such as a tractor, a rice planting machine, a binder, or a combine, a construction machine, such as a hydraulic power shovel, a truck-mounted crane, or a bulldozer, or a transporting machine, such as a dump truck, a forklift, a shovel loader, or a rough terrain hauler, the lubrication method is suitably used.

[Industrial Machine]

The industrial machine of the present invention includes the lubricating oil composition of the present invention.

An industrial machine of an aspect of the present invention is preferably an industrial machine provided with a transmission (gear), a hydraulically actuated part, and a wet brake.

Examples of the industrial machine provided with a transmission (gear), a hydraulically actuated part, and a wet brake include agricultural machines, such as a tractor, a rice planting machine, a binder, and a combine, construction machines, such as a hydraulic power shovel, a truck-mounted crane, and a bulldozer, and transporting machines, such as a dump truck, a forklift, a shovel loader, and a rough terrain hauler. From the viewpoint of capability of effective utilization of the excellent performances of the lubricating oil composition of the present invention, the industrial machine preferably has a mechanism that commonly lubricates a transmission (gear), a hydraulically actuated part, and a wet brake.

[An Aspect of the Present Invention Provided]

According to an aspect of the present invention, the following [1] to [13] are provided.

[1] A lubricating oil composition containing a base oil (A), a zinc dithiophosphate (B), and a sarcosine compound (C), the lubricating oil composition having a content of the sarcosine compound (C) of more than 0.05% by mass and 0.40% by mass or less based on the entire amount of the lubricating oil composition, and satisfying a requirement (α) or (β) described below:

requirement (α): when the content of the sarcosine compound (C) is more than 0.05% by mass and less than 0.20% by mass based on the entire amount of the lubricating oil composition, one or more phosphorus compounds (D) selected from the group consisting of an acidic phosphoric acid ester (D1) and an amine salt thereof (D2) are optionally contained;

requirement (β): when the content of the sarcosine compound (C) is 0.20% by mass or more and 0.40% by mass or less based on the entire amount of the lubricating oil composition, the phosphorus compound (D) is contained in an amount less than 0.50% by mass based on the entire amount of the lubricating oil composition.

[2] The lubricating oil composition according to the above [1], wherein when the requirement (α) is satisfied, a requirement (α1) described below is further satisfied:

requirement (α1): the sarcosine compound (C) and the zinc dithiophosphate (B) are contained at a ratio [(C)/(B)] of more than 0.04 and less than 0.17 by mass.

[3] The lubricating oil composition according to the above [1] or [2], wherein when the requirement (α) is satisfied, a requirement (α2) described below is further satisfied:

requirement (α2): the phosphorus compound (D) and the zinc dithiophosphate (B) are contained at a ratio [(D)/(B)] of 1.04 or less by mass.

[4] The lubricating oil composition according to the above [1], wherein when the requirement (β) is satisfied, a requirement (β1) described below is further satisfied:

requirement (β1): the sarcosine compound (C) and the zinc dithiophosphate (B) are contained at a ratio [(C)/(B)] of 0.33 or less by mass.

[5] The lubricating oil composition according to the above [1] or [4], wherein when the requirement (β) is satisfied, a requirement (β2) described below is further satisfied:

requirement (β2): the phosphorus compound (D) and the zinc dithiophosphate (B) are contained at a ratio [(D)/(B)] of less than 0.42 by mass.

[6] The lubricating oil composition according to any one of the above [1] to [5], wherein the sarcosine compound (C) is a sarcosine compound (C1) represented by the following general formula (c-1):

(c-1)

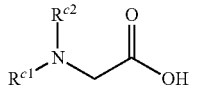

wherein $R^{c1}$ represents a hydrocarbon group having 2 to 30 carbon atoms and optionally containing a heteroatom, and $R^{c2}$ represents a hydrogen atom or a methyl group.

[7] The lubricating oil composition according to the above [6], wherein the sarcosine compound (C1) is a sarcosine compound (C2) represented by the following general formula (c-2):

(c-2)

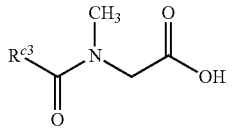

wherein $R^{C3}$ represents a hydrocarbon group having 1 to 29 carbon atoms.

[8] The lubricating oil composition according to any one of the above [1] to [7], wherein the lubricating oil composition is used for lubrication of an industrial machine.

[9] The lubricating oil composition according to the above [8], wherein the industrial machine includes a transmission, a hydraulically actuated part, and a wet brake.

[10] The lubricating oil composition according to the above [8] or [9], wherein the industrial machine is an agricultural machine.

[11] A method of lubricating an industrial machine, the method using the lubricating oil composition according to any one of the above [1] to [7].

[12] The lubrication method according to the above [11], wherein the industrial machine includes a transmission, a hydraulically actuated part, and a wet brake.

[13] The lubrication method according to the above [11] or [12], wherein the industrial machine is an agricultural machine.

EXAMPLES

The present invention will be more specifically described below with reference to the following examples, but the present invention is not limited to the examples.

[Measurement Methods of Various Physical Property Values]

Measurements of properties of raw materials used in Examples and Comparative Examples and lubricating oil compositions of Examples and Comparative Examples were performed according to the guides provided below.

(1) 40° C. Kinematic Viscosity, 100° C. Kinematic Viscosity, and Viscosity Index The 40° C. kinematic viscosity, 100° C. kinematic viscosity, and viscosity index of a base oil were measured and calculated according to JIS K2283:2000.

The 40° C. kinematic viscosity, 100° C. kinematic viscosity, and viscosity index of a lubricating oil composition were also measured and calculated according to JIS K2283:2000.

(2) Base Number

The base number of a lubricating oil composition was measured by a potentiometric method (hydrochloric acid method) according to JIS K2501:2003.

(3) Content of Various Atoms

The contents of calcium atoms, phosphorus atoms, zinc atoms, and sulfur atoms in a lubricating oil composition were measured according to JIS-5S-38-03.

The content of nitrogen atoms in a lubricating oil composition was measured according to JIS K2609:1998.

Examples 1 to 9, Comparative Examples 1 to 7

Base oils and various additives as shown below were sufficiently mixed in blended amounts (% by mass) shown in Table 1 to prepare a lubricating oil composition.

Details of base oils and various additives used in Examples 1 to 9 and Comparative Examples 1 to 7 are as follows.

<Base Oil (A)>

"100N Mineral oil": 40° C. kinematic viscosity=30.0 $mm^2/s$, 100° C. kinematic viscosity=4.5 $mm^2/s$, viscosity index=125

"500N Mineral oil": 40° C. kinematic viscosity=90.5 $mm^2/s$, 100° C. kinematic viscosity=10.9 $mm^2/s$, viscosity index=107

<Zinc Dithiophosphate (B)>

"Primary zinc dialkyldithiophosphate (primary ZnDTP)": a mixture of compounds containing a primary alkyl group having 4 carbon atoms as a majority of the alkyl groups and containing a primary alkyl group having 6 and 8 carbon atoms as another alkyl group <Sarcosine Compound (C)>

"N-Oleoyl sarcosine": a sarcosine compound of the general formula (c-2) in which $R^{C3}$ is an alkenyl group having 17 carbon atoms <Phosphorus Compound (D)>

"Acidic phosphoric acid ester amine salt (D2)": An amine salt of alkyl acid phosphates and alkenyl acid phosphates The alkyl acid phosphates and alkenyl acid phosphates are a mixture of monooleyl acid phosphate, monooctyl acid phosphate, dioleyl acid phosphate, dioctyl acid phosphate, and didodecyl acid phosphate.

The amine salt is a mixture of dodecylamine salts and undecylamine salts.

"Acidic phosphoric acid ester (D1)": oleyl acid phosphate

<Viscosity Index Improver>

"Viscosity index improver A": non-dispersant-type polymethacrylate (Mw=$14\times10^5$, resin content=39% by mass)

"Viscosity index improver B": non-dispersant-type polymethacrylate (Mw=$2.9\times10^5$, resin content=58% by mass)

"Viscosity index improver C": non-dispersant-type polymethacrylate (Mw=$5.0\times10^5$, resin content=not known)

The mass average molecular weight (Mw) of each viscosity index improver was a value measured by gel permeation chromatography and calculated based on polystyrene.

<Other Additives>

Friction modifier, anti-foaming agent, oily agent, antioxidant, dispersant, metal-based detergent, metal deactivator, rust inhibitor, and the like

[Evaluation 1: Evaluation of Brake Squeal Prevention Performance]

For each lubricating oil composition prepared in Examples and Comparative Examples, the coefficients of friction on a friction plate (A795.D0AK) and a steel plate (FZ132-8-Y2) were measured using a low velocity slipping friction apparatus (LVFA tester) based on JASO M 349:2012.

The test oil temperature in measurement was 80° C. and the surface pressure was 1 MPa.

The coefficient of friction was evaluated by the coefficient of friction $\mu_{50}$ at a rotation speed of 50 rpm.

The lower the coefficient of friction $\mu_{50}$ is, the more the stick-slip is suppressed and the better the brake squeal prevention performance is. Conversely, the higher the coefficient of friction $\mu_{50}$ is, the more the stick-slip is likely to occur and the poorer the brake squeal prevention performance is.

In the Examples, the brake squeal prevention performance was evaluated according to the following criteria.

The coefficient of friction $\mu_{50}$ being 0.114 or less: grade A (superior in brake squeal prevention performance)

The coefficient of friction $\mu_{50}$ being 0.115 or more: grade F (inferior in brake squeal prevention performance)

[Evaluation 2: Evaluation of Extreme Pressure Property]

The load withstanding capacity (anti-seizure performance) was evaluated according to JIS K2519:1995 using a Soda four-ball tester at a rotation speed of 200 rpm.

In the Examples, the anti-seizure performance was evaluated according to the following criteria.

The withstanding load being more than 0.55 MPa: grade A (superior in anti-seizure performance)

The withstanding load being more than 0.50 MPa and 0.55 MPa or less: grade B (a little inferior in anti-seizure performance)

The withstanding load being 0.50 MPa or less: grade F (inferior in anti-seizure performance)

The results are shown in Table 1 and Table 2.

In Table 1 and Table 2, the content of the viscosity index improver means a content including a diluting oil. In addition, in each lubricating oil composition, the total content of diluting oils derived from the viscosity index improvers A to C is more than 5.50% by mass and less than 6.00% by mass based on the entire amount of the lubricating oil composition.

TABLE 1

| | | | | Example 1 | Example 2 | Example 3 | Example 4 | Example 5 |
|---|---|---|---|---|---|---|---|---|
| Lubricating oil composition | Base oil (A) | Mineral oil 100N | % by mass | 80.35 | 80.22 | 80.10 | 79.60 | 79.10 |
| | | Mineral oil 500N | % by mass | 3.30 | 3.30 | 3.30 | 3.30 | 3.30 |
| | Zinc dithiophosphate (B) | Primary Zn DTP | % by mass | 1.20 | 1.20 | 1.20 | 1.20 | 1.20 |
| | Sarcosine compound (C) | N-Oleoyl sarcosine | % by mass | 0.10 | 0.10 | 0.10 | 0.10 | 0.10 |
| | Phosphorus compound (D) | Acidic phosphoric acid ester amine salt (D2) | % by mass | — | 0.13 | 0.25 | 0.75 | 1.25 |
| | | Acidic phosphoric acid ester (D1) | % by mass | — | — | — | — | — |
| | Viscosity index improver A | | % by mass | 4.20 | 4.20 | 4.20 | 4.20 | 4.20 |
| | Viscosity index improver B | | % by mass | 7.00 | 7.00 | 7.00 | 7.00 | 7.00 |
| | Viscosity index improver C | | % by mass | 0.50 | 0.50 | 0.50 | 0.50 | 0.50 |
| | Other additives | | % by mass | 3.35 | 3.35 | 3.35 | 3.35 | 3.35 |
| | Total | | % by mass | 100.00 | 100.00 | 100.00 | 100.00 | 100.00 |
| | [(C)/(B)] (by mass) | | — | 0.08 | 0.08 | 0.08 | 0.08 | 0.08 |
| | [(D)/(B)] (by mass) | | — | 0.00 | 0.11 | 0.21 | 0.63 | 1.04 |
| | [(D)/(C)] (by mass) | | — | 0.00 | 1.30 | 2.50 | 7.50 | 12.50 |
| Physical property value | 40° C. Kinematic viscosity | | $mm^2/s$ | 35.9 | 35.73 | 36 | 35.86 | 35.84 |
| | 100° C. Kinematic viscosity | | $mm^2/s$ | 8.18 | 8.153 | 8.181 | 8.178 | 8.161 |
| | Viscosity index | | — | 213 | 213 | 212 | 213 | 213 |
| | Base number (hydrochloric acid method) | | mgKOH/g | 11.3 | 10.7 | 10.5 | 8.37 | 6.37 |
| | Content of various atoms | Ca | ppm by mass | 3960 | 3920 | 3940 | 4060 | 4070 |
| | | P | ppm by mass | 865 | 923 | 963 | 1190 | 1410 |
| | | Zn | ppm by mass | 1110 | 1120 | 1110 | 1130 | 1150 |
| | | S | % by mass | 0.22 | 0.22 | 0.22 | 0.22 | 0.22 |
| | | N | ppm by mass | 410 | 430 | 480 | 600 | 740 |
| Evaluation result | Evaluation 1: brake squeal prevention performance | μ50 (80° C.) | — | 0.112 | 0.114 | 0.113 | 0.111 | 0.107 |
| | | Grade | — | A | A | A | A | A |
| | Evaluation 2: anti-seizure performance | Withstanding load | MPa | 0.80 | 0.70 | 0.70 | 0.60 | 0.55 |
| | | Grade | — | A | A | A | A | B |

| | | | | Example 6 | Example 7 | Example 8 | Example 9 |
|---|---|---|---|---|---|---|---|
| Lubricating oil composition | Base oil (A) | Mineral oil 100N | % by mass | 80.19 | 80.00 | 79.90 | 79.80 |
| | | Mineral oil 500N | % by mass | 3.30 | 3.30 | 3.30 | 3.30 |
| | Zinc dithiophosphate (B) | Primary Zn DTP | % by mass | 1.20 | 1.20 | 1.20 | 1.20 |
| | Sarcosine compound (C) | N-Oleoyl sarcosine | % by mass | 0.10 | 0.20 | 0.30 | 0.40 |
| | Phosphorus compound (D) | Acidic phosphoric acid (ester amine salt D2) | % by mass | — | 0.25 | 0.25 | 0.25 |
| | | Acidic phosphoric acid ester (D1) | % by mass | 0.16 | — | — | — |
| | Viscosity index improver A | | % by mass | 4.20 | 4.20 | 4.20 | 4.20 |
| | Viscosity index improver B | | % by mass | 7.00 | 7.00 | 7.00 | 7.00 |
| | Viscosity index improver C | | % by mass | 0.50 | 0.50 | 0.50 | 0.50 |
| | Other additives | | % by mass | 3.35 | 3.35 | 3.35 | 3.35 |
| | Total | | % by mass | 100.00 | 100.00 | 100.00 | 100.00 |
| | [(C)/(B)] (by mass) | | — | 0.08 | 0.17 | 0.25 | 0.33 |
| | [(D)/(B)] (by mass) | | — | 0.13 | 0.21 | 0.21 | 0.21 |
| | [(D)/(C)] (by mass) | | — | 1.60 | 1.25 | 0.83 | 0.63 |
| Physical property value | 40° C. Kinematic viscosity | | $mm^2/s$ | 35.77 | 36.02 | 35.58 | 35.76 |
| | 100° C. Kinematic viscosity | | $mm^2/s$ | 8.173 | 8.181 | 8.142 | 8.157 |
| | Viscosity index | | — | 214 | 212 | 214 | 213 |
| | Base number (hydrochloric acid method) | | mgKOH/g | 9.79 | 10.5 | 10.4 | 10.3 |
| | Content of various atoms | Ca | ppm by mass | 3940 | 3960 | 3960 | 4050 |
| | | P | ppm by mass | 984 | 960 | 988 | 992 |
| | | Zn | ppm by mass | 1130 | 1110 | 1140 | 1140 |
| | | S | % by mass | 0.21 | 0.22 | 0.22 | 0.22 |
| | | N | ppm by mass | 400 | 510 | 540 | 570 |
| Evaluation result | Evaluation 1: brake squeal prevention performance | μ50 (80° C.) | — | 0.109 | 0.112 | 0.112 | 0.107 |
| | | Grade | — | A | A | A | A |
| | Evaluation 2: anti-seizure performance | Withstanding load | MPa | 0.70 | 0.70 | 0.60 | 0.55 |
| | | Grade | — | A | A | A | B |

TABLE 2

| | | | | Comparative Example 1 | Comparative Example 2 | Comparative Example 3 | Comparative Example 4 |
|---|---|---|---|---|---|---|---|
| Lubricating oil composition | Base oil (A) | Mineral oil 100N | % by mass | 80.45 | 80.40 | 80.25 | 80.05 |
| | | Mineral oil 500N | % by mass | 3.30 | 3.30 | 3.30 | 3.30 |
| | Zinc dithiophosphate (B) | Primary Zn DTP | % by mass | 1.20 | 1.20 | 1.20 | 1.20 |
| | Sarcosine compound (C) | N-Oleoyl sarcosine | % by mass | — | 0.05 | 0.20 | 0.40 |
| | Phosphorus compound (D) | Acidic phosphoric acid ester amine salt (D2) | % by mass | — | — | — | — |
| | | Acidic phosphoric acid ester (D1) | % by mass | — | — | — | — |
| | Viscosity index improver A | | % by mass | 4.20 | 4.20 | 4.20 | 4.20 |
| | Viscosity index improver B | | % by mass | 7.00 | 7.00 | 7.00 | 7.00 |
| | Viscosity index improver C | | % by mass | 0.50 | 0.50 | 0.50 | 0.50 |
| | Other additives | | % by mass | 3.35 | 3.35 | 3.35 | 3.35 |
| | Total | | % by mass | 100.00 | 100.00 | 100.00 | 100.00 |
| | [(C)/(B)] (by mass) | | — | 0.00 | 0.04 | 0.17 | 0.33 |
| | [(D)/(B)] (by mass) | | — | 0.00 | 0.00 | 0.00 | 0.00 |
| | [(D)/(C)] (by mass) | | — | | 0.00 | 0.00 | 0.00 |
| Physical property value | 40° C. Kinematic viscosity | | $mm^2/s$ | 35.83 | 35.62 | 35.93 | 35.88 |
| | 100° C. Kinematic viscosity | | $mm^2/s$ | 8.158 | 8.143 | 8.185 | 8.166 |
| | Viscosity index | | — | 213 | 214 | 213 | 213 |
| | Base number (hydrochloric acid method) | | mgKOH/g | 11.3 | 11.2 | 11.2 | 11.2 |
| | Content of various atoms | Ca | ppm by mass | 3950 | 3940 | 3950 | 3950 |
| | | P | ppm by mass | 861 | 880 | 863 | 864 |
| | | Zn | ppm by mass | 1110 | 1120 | 1110 | 1100 |
| | | S | % by mass | 0.22 | 0.22 | 0.22 | 0.22 |
| | | N | ppm by mass | 370 | 390 | 450 | 510 |
| Evaluation result | Evaluation 1: brake squeal prevention performance | μ50 (80° C.) | — | 0.123 | 0.115 | 0.115 | 0.117 |
| | | Grade | — | F | F | F | F |
| | Evaluation 2: anti-seizure performance | Withstanding load | MPa | 0.55 | 0.75 | 0.75 | 0.80 |
| | | Grade | | B | A | A | A |

| | | | | Comparative Example 5 | Comparative Example 6 | Comparative Example 7 |
|---|---|---|---|---|---|---|
| Lubricating oil composition | Base oil (A) | Mineral oil 100N | % by mass | 80.20 | 79.95 | 79.65 |
| | | Mineral oil 500N | % by mass | 3.30 | 3.30 | 3.30 |
| | Zinc dithiophosphate (B) | Primary Zn DTP | % by mass | 1.20 | 1.20 | 1.20 |
| | Sarcosine compound (C) | N-Oleoyl sarcosine | % by mass | — | — | 0.30 |
| | Phosphorus compound (D) | Acidic phosphoric acid ester amine salt (D2) | % by mass | 0.25 | 0.50 | 0.50 |
| | | Acidic phosphoric acid ester (D1) | % by mass | — | — | — |
| | Viscosity index improver A | | % by mass | 4.20 | 4.20 | 4.20 |
| | Viscosity index improver B | | % by mass | 7.00 | 7.00 | 7.00 |
| | Viscosity index improver C | | % by mass | 0.50 | 0.50 | 0.50 |
| | Other additives | | % by mass | 3.35 | 3.35 | 3.35 |
| | Total | | % by mass | 100.00 | 100.00 | 100.00 |
| | [(C)/(B)] (by mass) | | — | 0.00 | 0.00 | 0.25 |
| | [(D)/(B)] (by mass) | | — | 0.21 | 0.42 | 0.42 |
| | [(D)/(C)] (by mass) | | — | — | — | 1.67 |
| Physical property value | 40° C. Kinematic viscosity | | $mm^2/s$ | 35.92 | 35.62 | 36.09 |
| | 100° C. Kinematic viscosity | | $mm^2/s$ | 8.166 | 8.137 | 8.208 |
| | Viscosity index | | — | 212 | 213 | 213 |
| | Base number (hydrochloric acid method) | | mgKOH/g | 10.6 | 9.6 | 9.49 |
| | Content of various atoms | Ca | ppm by mass | 3950 | 4070 | 3950 |
| | | P | ppm by mass | 950 | 1080 | 1050 |
| | | Zn | ppm by mass | 1100 | 1130 | 1100 |
| | | S | % by mass | 0.22 | 0.22 | 0.21 |
| | | N | ppm by mass | 440 | 500 | 620 |
| Evaluation result | Evaluation 1: brake squeal prevention performance | μ50 (80° C.) | — | 0.115 | 0.117 | 0.110 |
| | | Grade | — | F | F | A |
| | Evaluation 2: anti-seizure performance | Withstanding load | MPa | 0.90 | 0.60 | 0.35 |
| | | Grade | — | A | A | F |

The following can be seen in Table 1 and Table 2.

The lubricating oil compositions of Examples 1 to 6 are superior in the brake squeal prevention performance and the anti-seizure performance since the lubricating oil compositions each contain the base oil (A), the zinc dithiophosphate (B), and the sarcosine compound (C) and satisfy the requirement (α).

The lubricating oil compositions of Examples 7 to 9 are superior in the brake squeal prevention performance and the anti-seizure performance since the lubricating oil compositions each contain the base oil (A), the zinc dithiophosphate (B), and the sarcosine compound (C) and satisfy the requirement (β).

In contrast, the lubricating oil compositions of Comparative Examples 1, 5, and 6 are inferior in the brake squeal prevention performance since the lubricating oil compositions do not contain the sarcosine compound (C). Note that even when the phosphorus compound (D) is contained as in the lubricating oil compositions of Comparative Examples 5 and 6, the lubricating oil composition is inferior in the brake squeal prevention performance unless the sarcosine compound (C) is contained.

The lubricating oil composition of Comparative Example 2 is inferior in the brake squeal prevention performance in spite of containing the base oil (A), the zinc dithiophosphate (B), and the sarcosine compound (C) since the content of the sarcosine compound (C) is 0.05% by mass.

The lubricating oil compositions of Comparative Examples 3, 4, and 7 are inferior in the brake squeal prevention performance in spite of containing the base oil (A), the zinc dithiophosphate (B), and the sarcosine compound (C) since neither the requirement (α) nor the requirement (β) is satisfied.

The invention claimed is:

1. A lubricating oil composition, comprising:

a base oil;

a zinc dithiophosphate; and a sarcosine compound, wherein a content of the sarcosine compound is 0.10% by mass or more and 0.40% by mass or less based on the entire amount of the lubricating oil composition, a content of the base oil is 65% by mass to 95% by mass based on the entire amount of the lubricating oil composition, a content of the zinc dithiophosphate is 1.00% by mass to 1.40% by mass based on the entire amount of the lubricating oil composition, the base oil has a 100° C. kinematic viscosity of 1 $mm^2/s$ or more and 25 $mm^2/s$ or less, the lubricating oil composition satisfies a requirement (α) or (β) where the requirement (α) requires that when the content of the sarcosine compound is 0.10% by mass or more and less than 0.20% by mass based on the entire amount of the lubricating oil composition, one or more phosphorus compounds selected from the group consisting of an acidic phosphoric acid ester and an amine salt thereof are optionally contained, and a content of the one or more phosphorus compounds is 1.25% by mass or less based on the entire amount of the lubricating oil composition, and the requirement (β) requires that when the content of the sarcosine compound is 0.20% by mass or more and 0.40% by mass or less based on the entire amount of the lubricating oil composition, the one or more phosphorus compounds is contained in an amount less than 0.50% by mass based on the entire amount of the lubricating oil composition, the lubricating oil composition has a coefficient of friction $\mu_{50}$ of 0.114 or less at a rotation speed of 50 rpm, a test oil temperature of 80° C. and a surface pressure of 1 MPa, measured on a friction plate and a steel plate by a low velocity slipping friction apparatus tester based on JASO M 349, the lubricating oil composition has a load withstanding capacity of more than 0.50 MPa, measured with a Soda four-ball tester at a rotation speed of 200 rpm according to JIS K2519, the base oil is a mineral oil, the zinc dithiophosphate has formula (b-1), (b-1)

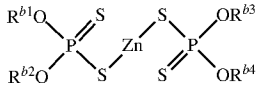

where $R^{b1}$, $R^{b2}$, $R^{b3}$ and $R^{b4}$ each independently are an alkyl group having 1 to 24 carbon atoms, the sarcosine compound conforms to has formula (c-2), (c-2)

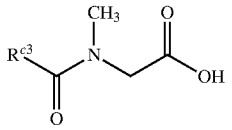

where $R^{C3}$ is a hydrocarbon group having 1 to 29 carbon atoms, the acidic phosphoric acid ester has formula (d-1), (d-1)

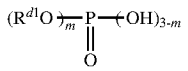

where $R^{d1}$'s each independently are an alkyl group having 2 to 20 carbon atoms or an alkenyl group having 2 to 20 carbon atoms, and m is 1 or 2, and the amine salt is formed from the acidic phosphoric acid ester and an amine of formula (d-2), $$R_n^{d2}-NH_{3-n} \quad \text{(d-2)}$$

where $R^{d2}$ is an alkyl group having 6 to 18 carbon atoms, and n is 1, 2, or 3.

2. The lubricating oil composition according to claim 1, wherein when the lubricating oil composition satisfies the requirement (α), the lubricating oil composition further satisfies a requirement (α1) where the requirement (α1) requires that the sarcosine compound and the zinc dithiophosphate are contained at a ratio, the sarcosine compound/the zinc dithiophosphate, of more than 0.04 and less than 0.17 by mass.

3. The lubricating oil composition according to claim 1, wherein when the lubricating oil composition satisfies the requirement (α), the lubricating oil composition further satisfies a requirement (α2) where the requirement (α2) requires that the phosphorus compound and the zinc dithiophosphate are contained at a ratio, the phosphorus compound/the zinc dithiophosphate, of 1.04 or less by mass.

4. The lubricating oil composition according to claim 1, wherein when the lubricating oil composition satisfies the requirement (β), the lubricating oil composition further satisfies a requirement (β1) where the requirement (β1) requires that the sarcosine compound and the zinc dithiophosphate are contained at a ratio, the sarcosine compound/the zinc dithiophosphate, of 0.33 or less by mass.

5. The lubricating oil composition according to claim 1, wherein when the lubricating oil composition satisfies the requirement (β), the lubricating oil composition further satisfies a requirement (β2) where the requirement (β2) requires that the phosphorus compound and the zinc dithiophosphate are contained at a ratio, the phosphorus compound/the zinc dithiophosphate, of less than 0.42 by mass.

6. A method of lubricating an industrial machine, comprising:

lubricating the industrial machine with the lubricating oil composition of claim 1.

7. The lubrication method according to claim 6, wherein the industrial machine comprises a transmission, a hydraulically actuated part, and a wet brake.

8. The lubrication method according to claim 6, wherein the industrial machine is an agricultural machine.

9. The lubricating oil composition according to claim 1, wherein the content of the base oil is in a range of 82.40% by mass to 83.65% by mass based on the entire amount of the lubricating oil composition.

10. The lubricating oil composition according to claim 9, wherein the base oil includes mineral oil 100N and mineral oil 500N.

11. The lubricating oil composition according to claim 1, wherein the lubricating oil composition satisfies the requirement ($\alpha$) and a requirement ($\alpha 1$) where the requirement ($\alpha 1$) requires that the sarcosine compound and the zinc dithiophosphate are contained at a ratio, the sarcosine compound/the zinc dithiophosphate, of more than 0.04 and less than 0.17 by mass.

12. The lubricating oil composition according to claim 1, wherein the lubricating oil composition satisfies the requirement ($\alpha$) and a requirement ($\alpha 2$) where the requirement ($\beta 2$) requires that the phosphorus compound and the zinc dithiophosphate are contained at a ratio, the phosphorus compound/the zinc dithiophosphate, of 1.04 or less by mass.

13. The lubricating oil composition according to claim 1, wherein the lubricating oil composition satisfies the requirement ($\beta$) and a requirement ($\beta 1$) where the requirement ($\beta 1$) requires that the sarcosine compound and the zinc dithiophosphate are contained at a ratio, the sarcosine compound/the zinc dithiophosphate, of 0.33 or less by mass.

14. The lubricating oil composition according to claim 1, wherein the lubricating oil composition satisfies the requirement ($\beta$) and a requirement ($\beta 2$) where the requirement ($\beta 2$) requires that the phosphorus compound and the zinc dithiophosphate are contained at a ratio, the phosphorus compound/the zinc dithiophosphate, of less than 0.42 by mass.

15. The lubricating oil composition according to claim 11, wherein the content of the base oil is in a range of 82.40% by mass to 83.65% by mass based on the entire amount of the lubricating oil composition.

16. The lubricating oil composition according to claim 15, wherein the base oil includes mineral oil 100N and mineral oil 500N.

17. The lubricating oil composition according to claim 12, wherein the content of the base oil is in a range of 82.40% by mass to 83.65% by mass based on the entire amount of the lubricating oil composition.

18. The lubricating oil composition according to claim 17, wherein the base oil includes mineral oil 100N and mineral oil 500N.

19. The lubricating oil composition according to claim 13, wherein the content of the base oil is in a range of 82.40% by mass to 83.65% by mass based on the entire amount of the lubricating oil composition.

20. The lubricating oil composition according to claim 1, wherein the coefficient of friction 1150 of the lubricating oil composition is in a range of 0.105 to 0.112, and the load withstanding capacity of the lubricating oil composition is in a range of 0.55 to 0.85 MPa.

* * * * *